US005536134A

United States Patent [19]

Hirooka

[11] Patent Number: 5,536,134

[45] Date of Patent: Jul. 16, 1996

[54] WORKING IMPLEMENT COUPLING APPARATUS

[75] Inventor: Masami Hirooka, Sakai, Japan

[73] Assignee: Kubota Corporation, Japan

[21] Appl. No.: 245,230

[22] Filed: May 17, 1994

[30] Foreign Application Priority Data

Aug. 27, 1993 [JP] Japan ..... 5-213033

[51] Int. Cl.[6] ..... E02F 3/627

[52] U.S. Cl. ..... 414/686; 172/273

[58] Field of Search ..... 414/686, 685; 172/272–275

[56] References Cited

U.S. PATENT DOCUMENTS

| | | | |
|---|---|---|---|
| 3,939,997 | 2/1976 | Frank | 414/686 |
| 3,991,890 | 11/1976 | Frank | 214/131 A |
| 4,217,075 | 8/1980 | Frank | 414/686 |
| 4,802,814 | 2/1989 | Kourogi et al. | 414/686 |
| 4,936,737 | 6/1990 | Rae et al. | 414/686 |

FOREIGN PATENT DOCUMENTS 2265881 10/1993 United Kingdom ..... E02F 3/627

*Primary Examiner*—Donald W. Underwood

*Attorney, Agent, or Firm*—Webb Ziesenheim Bruening Logsdon Orkin & Hanson

[57] ABSTRACT

A front loader coupling apparatus for a front loader having masts attachable to mast mounts of a tractor, and booms, boom cylinders and braces. The front loader coupling apparatus includes a first coupling device provided on the masts and mast mounts, a second coupling device disposed above the first coupling device, a stand device connected to the masts, and a brace connecting device. The brace connecting device includes a receiver for receiving a cross rod of the braces. The receiver has a fixing device for fitting on the cross rod from above when the masts are attached to the mast mounts, and a support for supporting the cross rod from below when the cross rod is uncoupled from the fixing device. The fixing device and the support define a space therebetween for enabling forward parallel movement of the cross rod.

13 Claims, 13 Drawing Sheets

WORKING IMPLEMENT COUPLING APPARATUS

BACKGROUND OF THE INVENTION

1. Field of the Invention

The present invention relates to a coupling apparatus for attaching a working implement to the front of a tractor.

2. Description of the Related Art

Numerous improvements have been made heretofore in relation to the working implement coupling structure to facilitate attachment and detachment of working implements to/from tractors. One example of such improvements is described in U.S. Pat. No. 4,936,737. According to this working implement coupling apparatus, a pair of right and left masts pivotally support proximal ends of booms, and a bucket is attached to distal ends of the booms to act as a working tool. The apparatus includes boom cylinders for adjusting angles of the booms relative to the masts.

The masts are attached to mast mounts formed on a tractor body to be pivotable about a pivotal axis. A pair of fight and left braces extend forwardly and downwardly from the respective masts. The braces have forward ends thereof interconnected through a cross tube (or cross rod). The cross tube is attached to and detached from brace connectors arranged in front positions of the tractor body, by locking and unlocking a locking device.

For detaching the working implement in the above conventional structure, the locking device of the brace connectors is unlocked to release the cross tube (cross rod) from a front support assembly (corresponding to the brace connectors). Then, the boom cylinders are extended to swing the masts forward relative to the mast mounts. As a result, the forward ends of the braces are lowered to the ground. With the braces and working tool (bucket) resting on the ground, the masts are drawn upward from the mast mounts.

According to the above working implement coupling apparatus, however, the boom cylinders must be extended through a long stroke before the forward ends of the braces contact the ground. This leaves room for improvement in that a working implement detaching operation is a slow process.

SUMMARY OF THE INVENTION

An object of the present invention is to provide a working implement coupling apparatus which allows a working implement to be detached through a reduced stroke of boom cylinders, thereby to overcome the inconvenience of the prior art, i.e. to improve operability in time of implement detachment.

The above object is fulfilled, according to the present invention, by a coupling apparatus for a front loader having masts attachable to mast mounts of a tractor, and booms, boom cylinders and braces connected to the masts, the apparatus comprising first coupling means including a first engaging member formed on each of the masts, and a first engageable member formed on each of the mast mounts for pivotable engagement with the first engaging member; second coupling means disposed above the first coupling means, and including a second connecting member formed on each of the masts, a second connectable member formed on each of the mast mounts, and a connecting pin for connecting the second connecting member and the second connectable member; stand means for supporting the front loader when the masts are uncoupled from the mast mounts; and brace connecting means for connecting forward ends of the braces to a forward position of the tractor. The brace connecting means includes a cross rod disposed at the forward ends of the braces, and receiver means provided in the forward position of the tractor for receiving the cross rod. The receiver means has fixing means for fitting on the cross rod from above when the masts are attached to the mast mounts, and support means for supporting the cross rod from below when the cross rod is uncoupled from the fixing means. The fixing means and the support means define a space therebetween for enabling a forward parallel movement of the cross rod.

For detaching the front loader from the tractor, the cross rod interconnecting the fight and left braces is first uncoupled from the brace connecting means. Thereafter the connecting pins extending through the masts and mast mounts are removed.

Then, the boom cylinders are extended to cause the masts to pivot forward relative to the mast mounts. With this pivotal movement, the forward ends of the braces extending forward and downward from the masts move downward, whereby the cross rod moves downward out of engagement with the fixing means. With a further extending operation of the boom cylinders, the cross rod moves onto the support formed on the brace connecting means.

With a still further extending operation of the boom cylinders, the masts are separated upward from the mast mounts through a pivotal movement about the cross rod resting on the support. The boom cylinders are extended until the masts are raised to a height for enabling the stand means to be attached to stand attaching members provided on the masts. Then, the stand means is attached to the stand attaching members. With the load of the front loader borne by the stand means, the tractor is moved backward.

The front loader is attached to the tractor in a sequence reversed from the above.

With the above front loader coupling apparatus, the cross rod interconnecting the right and left braces is coupled to the brace connecting means provided at the front of the tractor. The front loader attaching or detaching operation is carried out through a pivotal movement about the cross rod supported by the brace connecting means. The boom cylinders may be extended and contracted through reduced strokes to expedite the operations to attach and detach of the front loader.

The foregoing and other objects, features and advantages of the invention will be apparent from the following more particular description of preferred embodiments of the invention, as illustrated in the accompanying drawings.

BRIEF DESCRIPTION OF THE DRAWINGS

The drawing show a front loader coupling apparatus according to the present invention, in which.

DETAILED DESCRIPTION OF THE PREFERRED EMBODIMENTS

Figure 1:
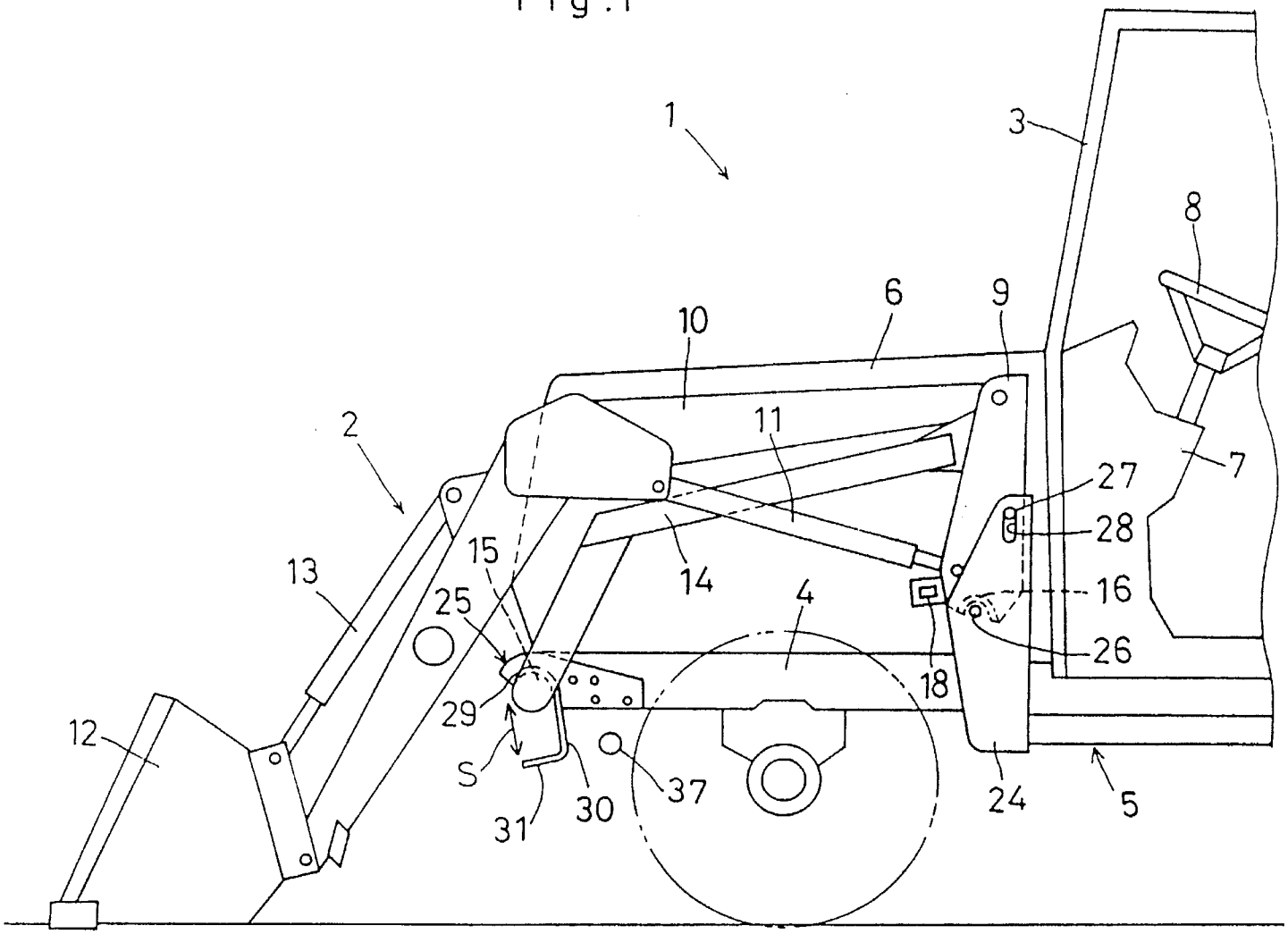
FIG. 1 is a side view of a working implement coupled to a working vehicle.

Embodiments of the present invention will be described with reference to the drawings.

In the embodiment shown in FIGS. 1 through 8, a tractor 1 has a working implement 2 exemplified by a front loader, and a cabin 3. The tractor 1 includes a body 5 formed of an engine, a clutch housing, a transmission case, and a front axle frame 4 extending from the engine. The engine is covered by a hood 6. The cabin 3 encloses a driver's section including a control panel 7, a steering wheel 8, and a driver's seat disposed rearwardly.

The working implement 2 includes a boom 10 having a proximal end thereof pivotally connected to an upper end of a mast 9. The boom 10 is vertically pivotable by a boom cylinder 11 pivotally connected between an intermediate position of the boom 10 and an intermediate position of the mast 9. A working tool 12 such as a bucket is connected to a distal end of the boom 10 to be pivotable by a tool cylinder 13 to take scooping and dumping action. A brace 14 extends forward and downward from an upper position of the mast 9.

Another set of mast 9, boom 10, boom cylinder 11 and brace 14 is provided on the other side of the tractor 1. The right and left booms 10 are connected to each other at forward ends thereof through the tool 12. The right and left braces 14 are connected to each other at forward ends thereof through a cross rod (or cross tube) 15.

Each mast 9 has a U-shaped cross section, with an inverted U-shaped member welded to a lower position thereof to form a pivotal support 16. Each mast 9 has pinholes 17 defined in vertically intermediate positions thereof above the pivotal sup port 16. Further, each mast 9 has a stand attaching member 18 projecting forward from a position below a pivotal connection of the boom cylinder 11.

Figure 6A:
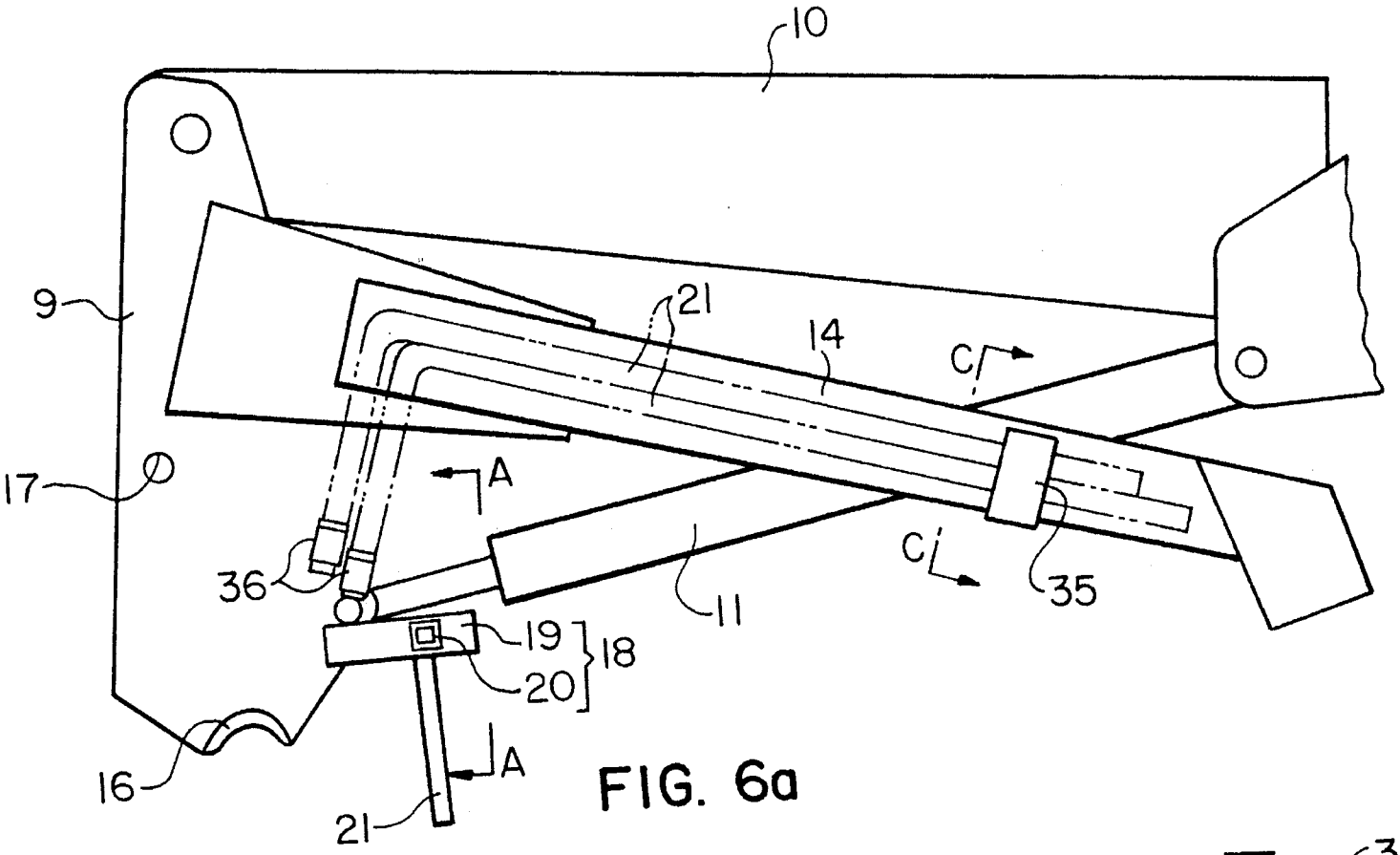
FIG. 6*a* is a side view showing an inner side of the working implement.
Figure 6B:
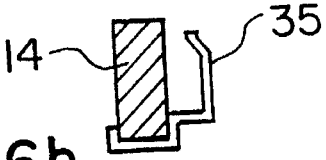
FIG. 6*b* is a section taken on line C—C of FIG. 6*a;*
Figure 7:
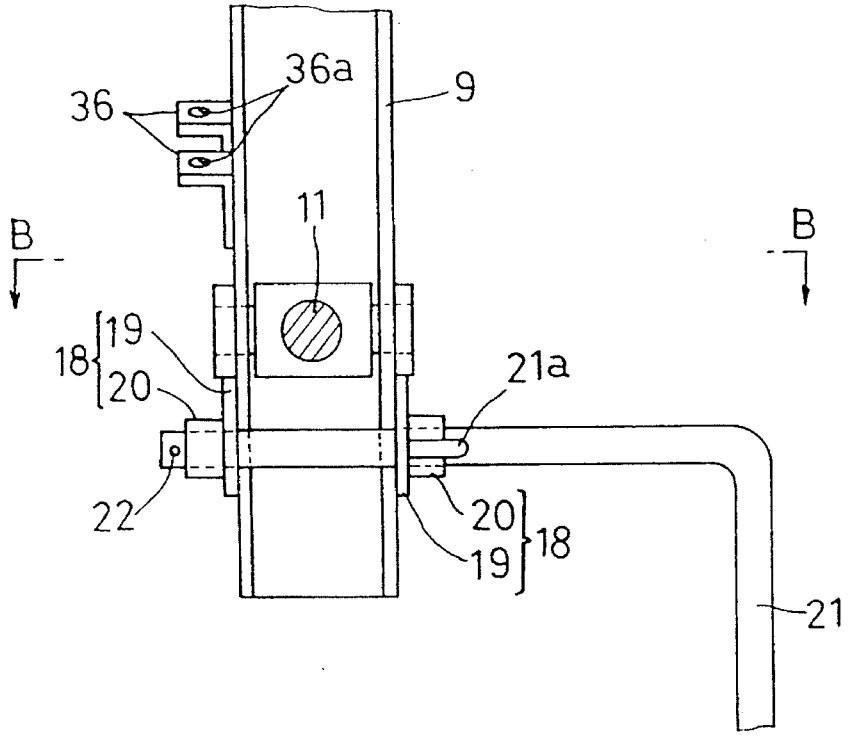
FIG. 7 is a section taken on line A—A of FIG. 6*a;*
Figure 8:
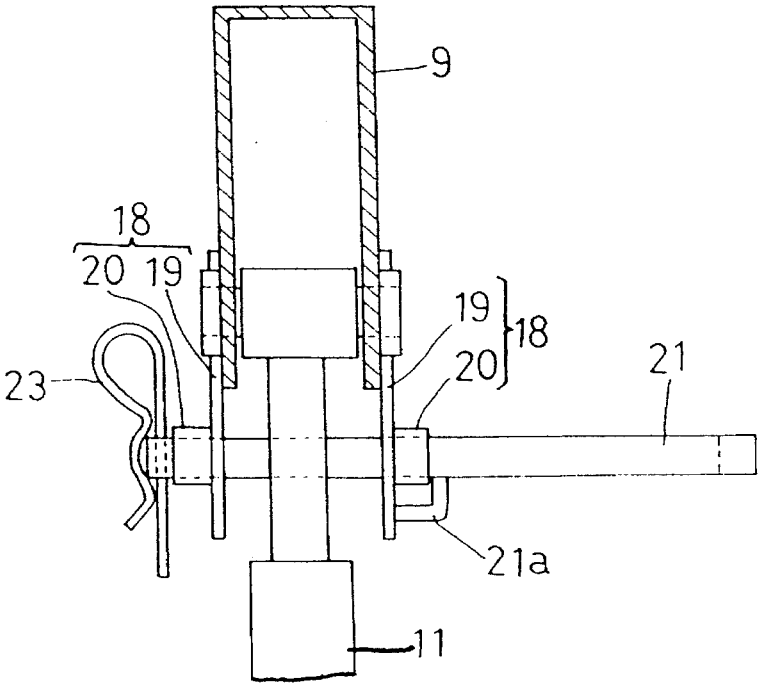
FIG. 8 is a section taken on line B—B of FIG. 7.

As shown in FIGS. 6 through 8, the stand attaching member 18 includes a pair of holder plates 19 welded to opposite side walls of the mast 9. Each holder plate 19 has a penetrable guide 20 in the form of a square pipe for receiving and holding an approximately L-shaped stand 21 inserted therein from an outer side. The stand 21 has a pinhole 22 formed in an end region thereof for receiving a retainer pin 23 to be retained in the position extending through the penetrable guides 20.

The tractor body 5 includes a mast mount 24 fixed to a longitudinally intermediate position on each side thereof. Brace connectors 25 are provided at a forward end of the front axle frame 4 for detachably attaching the cross rod (cross tube) 15 to connect the working implement 2 to the tractor body 5.

Each mast mount 24 has an approximately U-shaped cross section opening forward, and includes a pivot pin 26 extending through vertically intermediate positions thereof. Further, each mast mount 24 defines pin receiving slots 28 in upper positions thereof for receiving a connector pin 27. These pin receiving slots 28 are elongated vertically.

Figure 5:
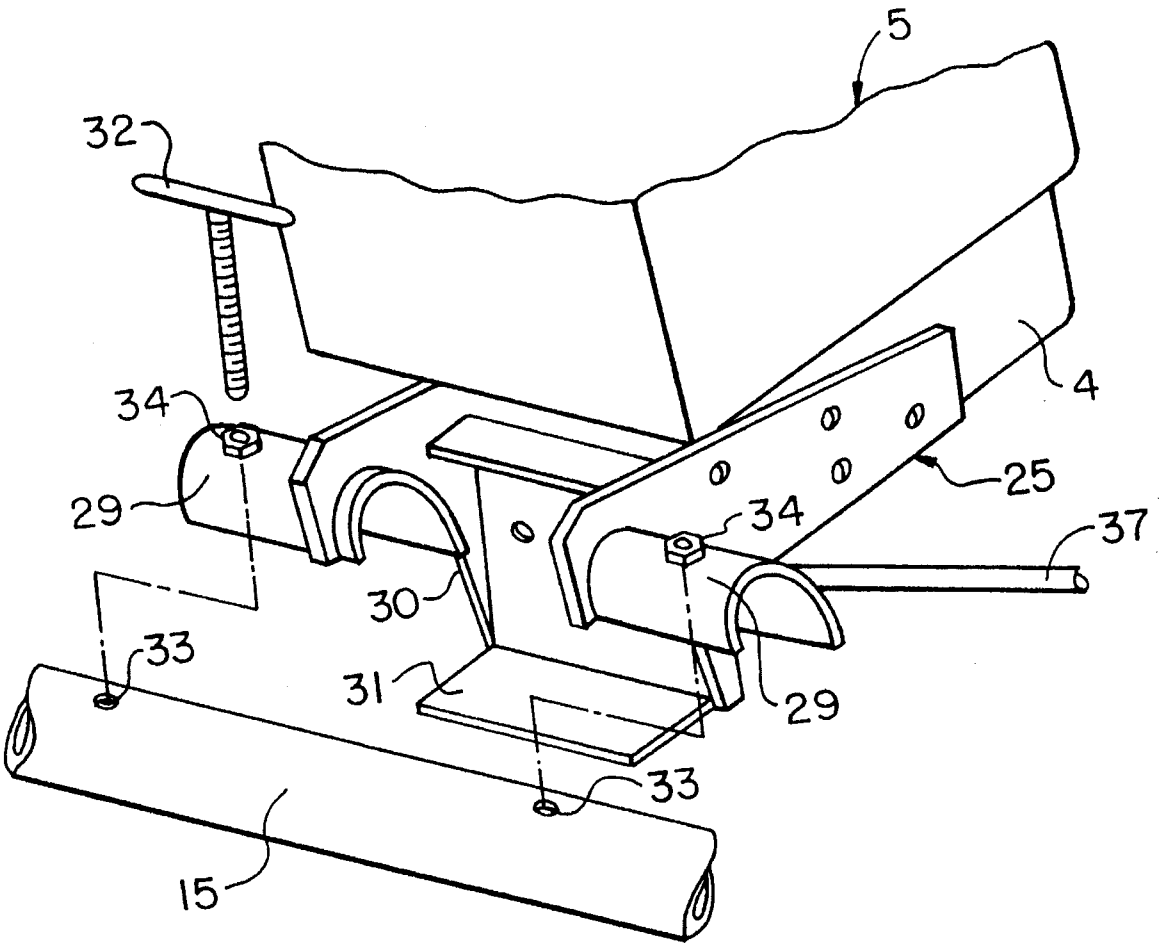
FIG. 5 is an enlarged perspective view showing the front of the working vehicle.

As shown in FIG. 5, the brace connectors 25 are bolted to forward lateral walls of the front axle frame 4. The brace connectors 25 include a pair of fight and left coupling and fixing members 29 in the form of half cylinders opening downward, a guide 30 disposed between and extending downward from rear portions of the coupling and fixing members 29, and a support 31 extending forward and downward from a lower end of the guide 30. The coupling and fixing members 29 and support 31 define a space S therebetween which is larger than the diameter of the cross rod (cross tube) 15 interconnecting the right and left braces 14, so that the cross rod 15 is forwardly separable from the brace connectors 25. The support 31 is inclined forward to allow the cross rod 15 to be detached forward and parallel to the ground.

When the working implement 2 is attached to the tractor 1, as shown in FIG. 1, the pivotal support 16 of each mast 9 engages the pivot pin 26 of the mast mount 24, and the connecting pin 27 is inserted through the pinholes 17 of the mast 9 and the pin receiving slots 28 of the mast mount 24, to fix the mast 9 to the mast mount 24. Thus, the connecting pin 27 acts as a fixing device for detachably attaching the mast 9 to the mast mount 24.

Further, the cross rod (cross tube) 15 interconnecting the right and left braces 14 is fitted from below into the coupling and fixing members 29 of the brace connectors 25. The cross rod. 15 is fixed to the coupling members 29 by means of T-bolts 32. The coupling members 29 and cross rod (cross tube) 15 have bolt bores 33 formed in and nuts 34 welded to corresponding positions thereof.

Operations to attach and detach the working implement 2 will be described next.

For detaching the working implement 2 in the position shown in FIG. 1, the connecting pins 27 are removed to disconnect the masts 9 from the mast mounts 24. The T-bolts 32 are removed to disconnect the cross rod (cross tube) 15 from the brace connectors 25.

Figure 2:
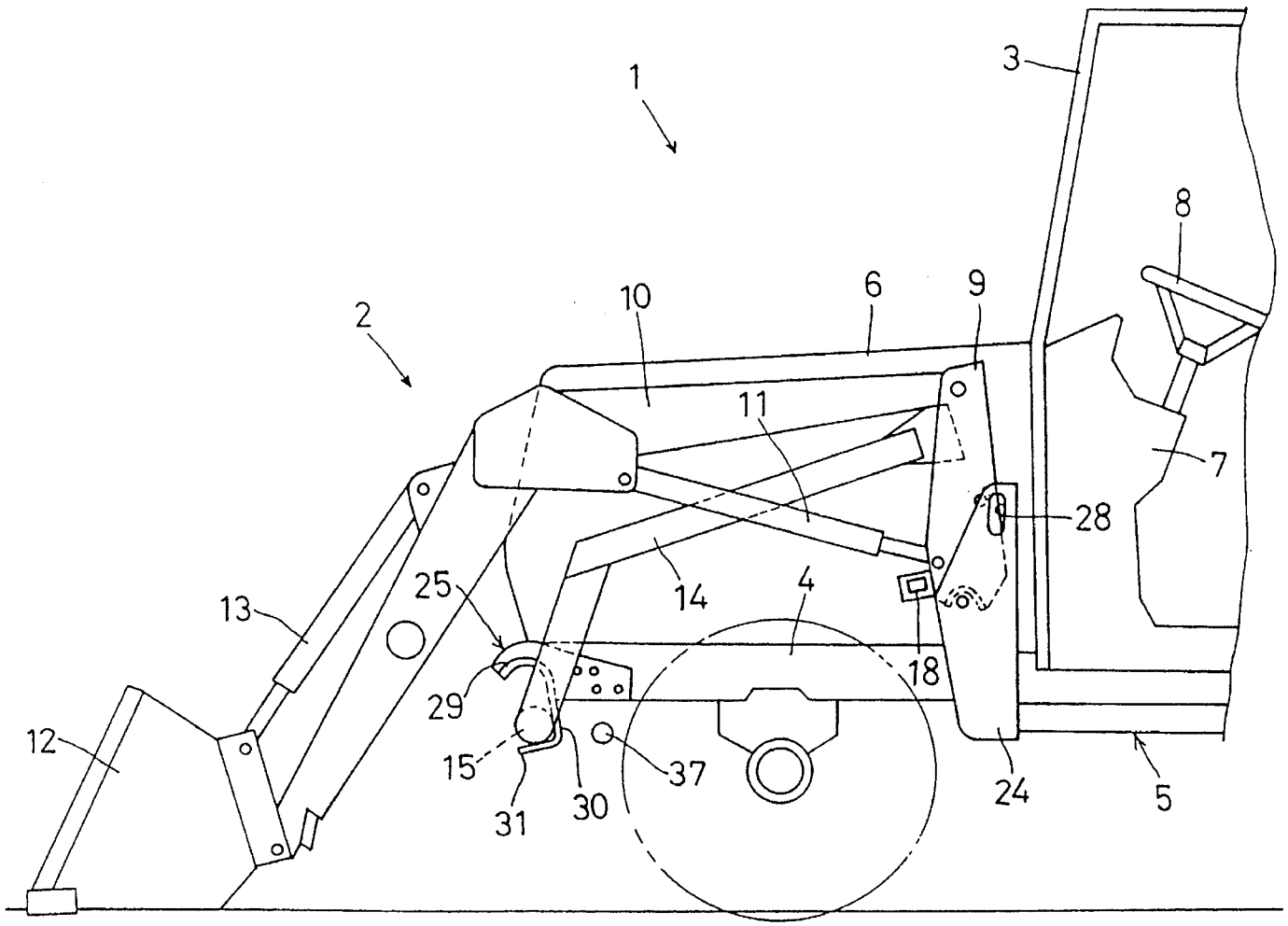
FIG. 2 is a side view of the working implement in process of coupling to or uncoupling from the working vehicle.

Then, as shown in FIG. 2, the boom cylinders 11 are extended to cause the masts 9 to pivot about the pivot pins 26 to a forwardly inclined posture with the lower ends thereof contacting the mast mounts 24. The working tool 12 slides forward on the ground.

At the same time, the cross rod (cross tube) 15 of the right and left braces 14 rigidly connected to the masts 9 disengages from the coupling and fixing members 29 of the brace connectors 25, and moves downward along a front surface of the guide 30 into contact with the support 31.

Figure 3:
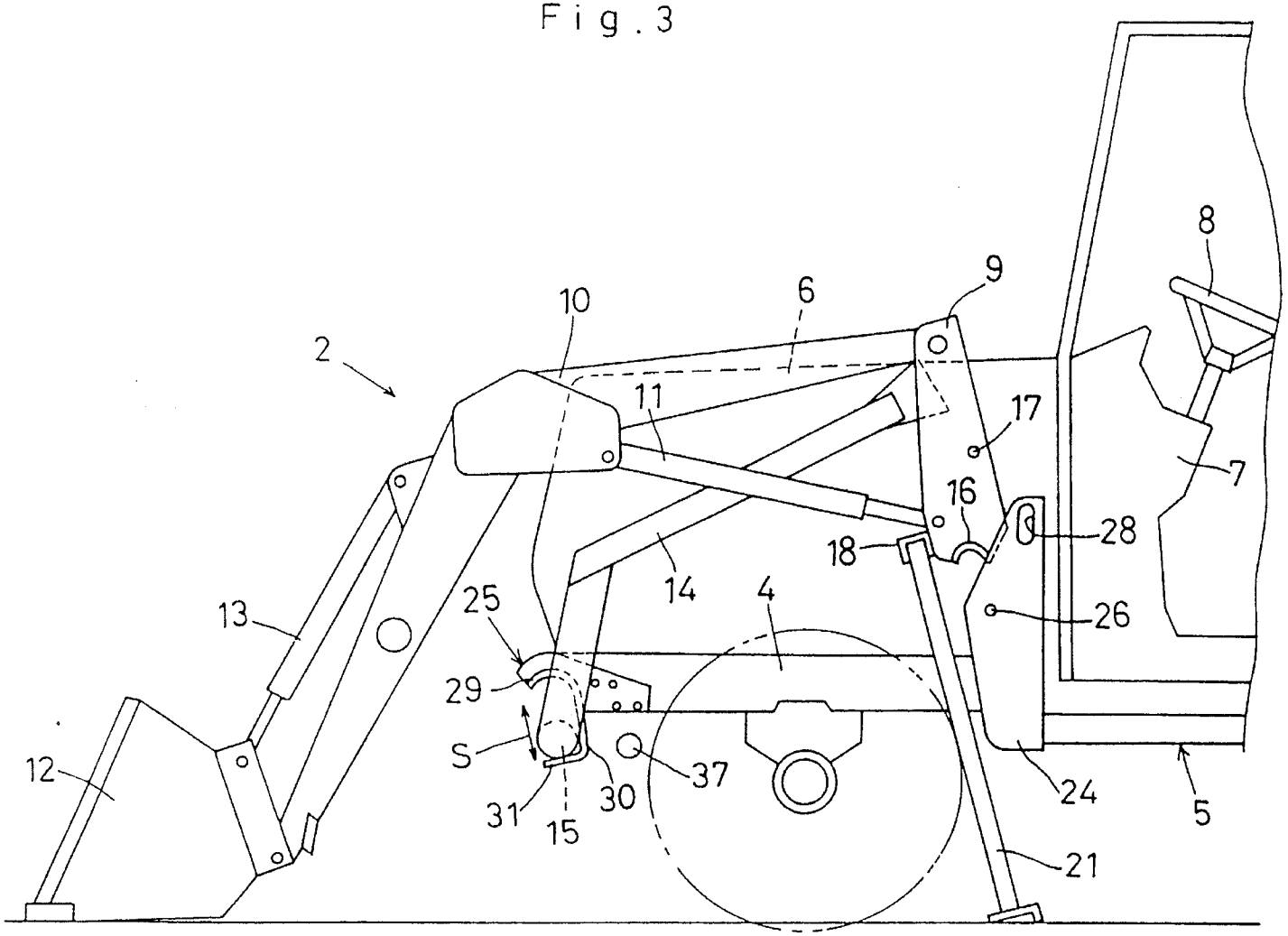
FIG. 3 is a side view of the working implement in process of coupling to or uncoupling from the working vehicle.

With the cross rod (cross tube) 15 resting on the support 31, the boom cylinders 11 are extended further. Consequently, as shown in FIG. 3, the masts 9 are moved upward away from the mast mounts 24. The extending operation of the boom cylinders 11 is stopped when the masts 9 have reached a height to allow attachment of the stands 21. Then, the stands 21 are attached to the stand attaching members 18 of the masts 9.

Next, the boom cylinders 11 are slightly contracted to lower the masts 9, with the load falling on the stands 21 instead of being transmitted through the cross rod (cross tube) 15 of the fight and left braces 14 to the support 31. After removing couplers of hydraulic piping and the like from the boom cylinders 11, the tractor 1 is driven backward. As a result, the cross rod (cross tube) 15 moves forward out of engagement with the brace connectors 25. This completes the operation to detach the working implement 2.

In the above example, the load of the working implement 2 is allowed to fall on the stands 21 by contracting the boom cylinders 11. Instead of contracting the boom cylinders 11, the support 31 may have a long surface inclined forward, and the tractor 1 may be driven backward after the stands 21 are attached to the stand attaching members 18. This causes the cross rod (cross tube) 15 to descend gradually along the support 31, whereby the load of the working implement 2 is borne by the stands 21.

Figure 4:
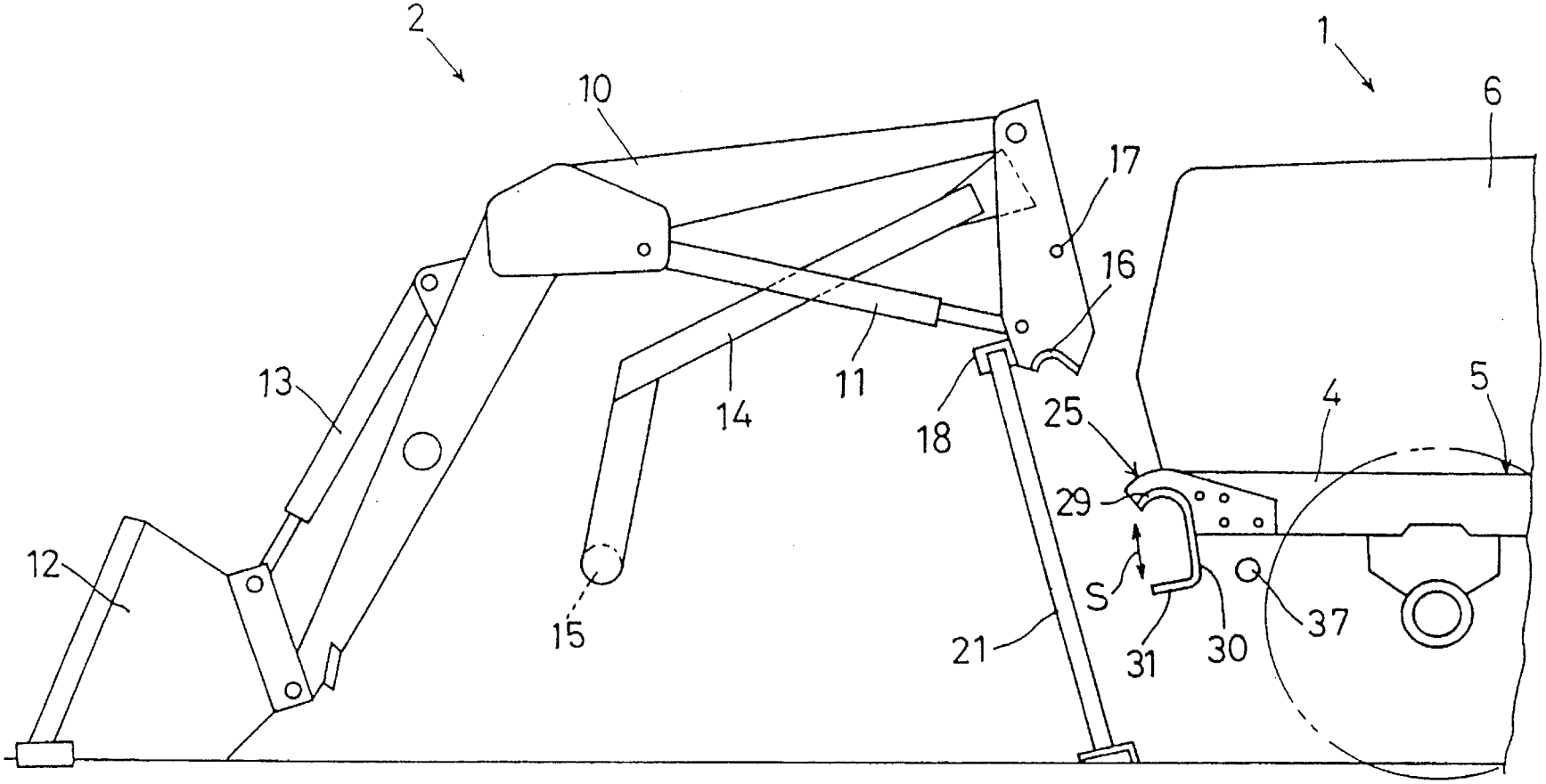
FIG. 4 is a side view of the working implement uncoupled from the working vehicle.

For attaching the working implement 2 in the position shown in FIG. 4 to the tractor body 5, the tractor body 5 is moved until the cross rod (cross tube) 15 of the fight and left braces 14 contacts the guide 30 of the brace connectors 25 as shown in FIG. 3. The hydraulic piping is connected, and the boom cylinders 11 are slightly extended so that the load is borne by the cross rod (cross tube) 15 contacting the support 31 of the brace connectors 25. Thereafter the stands 21 are removed.

The boom cylinders 11 are contracted to lower the masts 9 and engage the pivotal supports 16 with the pivot pins 26 as shown in FIG. 2. When the boom cylinders 11 are contracted further, the masts 9 pivot about the pivot pins 26. Then, as shown in FIG. 1, the cross rod (cross tube) 15 of the fight and left braces 14 engages the coupling members 29 of the brace connectors 25 from below.

At this time, the pinholes 17 of the masts 9 are aligned with the pin receiving slots 28 of the mast mounts 24. The connecting pins 27 are passed through the pinholes 17 and pin receiving slots 28 to connect the masts 9 to the mast mounts 24. The cross rod (cross tube) 15 is secured to the brace connectors 25 by means of the T-bolts 32.

As shown in FIGS. 6*a* and 6*b*, the left brace 14 has an elastically deformable spring plate 35 formed of a relatively thin material and attached to an inward surface thereof. Further, a pair of engaging members 36 are attached to an inward surface of the left mast 9. These provisions facilitate storage of the pair of right and left stands 21.

The engaging members 36 are in the form of L-shaped metal fittings attached to a side surface of the mast 9, each metal fitting defining an engaging bore 36*a* in a projecting arm thereof. Each stand 21 includes a hook 21 a formed adjacent the end thereof inserted into the holder plates 19. The hook 21*a* is inserted into the engaging bore 36*a* for storage. As shown in FIGS. 7 and 8, the hook 21*a* of each stand 21 contacts one of the holder plates 19 to position the stand 21 relative to the stand attaching member 18 when the stand 21 is connected to the stand attaching member 18.

According to the above storage structure, the stands 21 are fitted in the spring plate 35 and engaging members 36 from above. This facilitates a storage operation. When stored, the stands 21 extend along the inward surface of the brace 14 to present no obstruction to operation of the working implement 2.

In this embodiment, when the working implement 2 is attached, the cross rod (cross tube) 15 of the fight and left braces 14 is connected to the coupling members 29 of the brace connectors 25 disposed at the front of the tractor body 5. In the course of attaching or detaching the working implement 2, the cross rod (cross tube) 15 is supported by the support 31 of the brace connectors 25. The forward ends of the braces 14 are moved a less amount than a case in which the forward ends are placed on the ground to act as stands. Consequently, the boom cylinders 11 are operated through reduced strokes to expedite the attaching and detaching operations.

The tractor body 5 is moved after the boom cylinders 11 are operated to cause the stands 21 to support the working implement 2. It is possible to dispense with operation of the tool cylinder 13 by operating the boom cylinders 11 and moving the tractor body 5 backward and forward separately and independently. This renders the attaching and detaching operations simple and easy.

The working implement 2 does not lie far apart from the tractor body 5 (the position shown in FIG. 3) when removing the couplers of hydraulic piping from the boom cylinders 11 and the like after operating the boom cylinders 11 to cause the stands 21 to support the working implement 2. Thus, the hydraulic piping for the boom cylinders 11 and the like needs only a small dimensional margin for accommodating separation of the masts 9 from the tractor body 5.

When attaching the working implement 2 to the tractor body 5, the tractor body 5 may be driven straight forward toward the working implement 2. As a result, the cross rod (cross tube) 15 of the fight and left braces 14 is brought into contact with the guide 30 of the brace connectors 25. Thus, the working implement 2 is positionally adjusted to the tractor body 5 naturally and reliably, to facilitate the attaching operation. The brace connectors 25 are arranged forwardly of a tie rod 37 of the tractor to act as a front guard. Thus, the front of the tractor body 5 is protected even when the working implement 2 is detached.

An internal pressure may be applied to the boom cylinders 11 when the working implement 2 is left on the stands 21 for a long time. Then, the cylinders 11 may be extended due to oil drainage therefrom, resulting in instability such as a variation in relative angle between the masts 9 and mast mounts 24, and lowering the forward ends of the braces 14. An internal pressure may occur with the hydraulic piping on the working implement 2, making it difficult to connect couplers between the tractor body 5 and the hydraulic piping on the working implement 2.

If the forward ends of the fight and left braces 14 am lowered, the cross rod (cross tube) 15 of the braces 14 lies below the support 31 of the brace connectors 25 when the tractor body 5 is moved in an attaching operation. This may render the attaching operation difficult.

Figure 9:
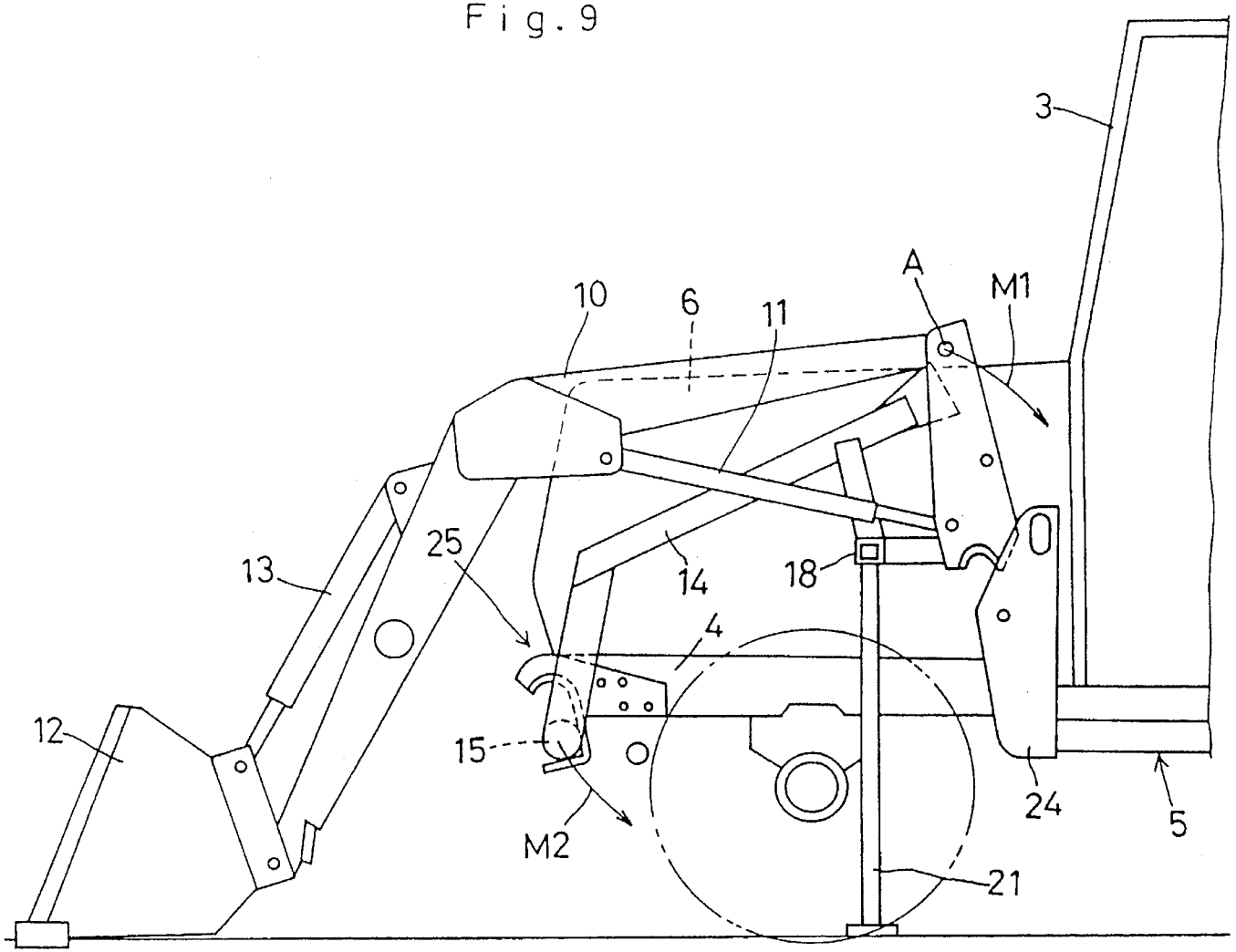
FIG. 9 is a view corresponding to FIG. 3 and showing a modified stand attaching member.

To avoid such inconveniences, as shown in FIG. 9, the stand attaching members 18 may preferably be disposed further forward. This modification reduces the internal pressure of the boom cylinders 11 by securing a balance between moment M1 about the stand attaching members 18 of the load acting on a pivotal point A between the booms 10 and masts 9, and moment M2 about the stand attaching members 18 of the weight of the braces 14. The present invention is not limited to the foregoing embodiment, but may be modified in various ways as appropriate.

FIGS. 10 through 13 show a coupling apparatus for coupling a working implement 2 in a different embodiment of the invention. Like reference numerals are used to identify like parts in the first embodiment and will not be described again. Different constructions and functions will be described.

The tractor 1 includes brace connectors 25 provided at the forward ends of the tractor body 5, the connectors 25 having no support (element referenced 31 in the first embodiment) extending forwardly from the lower end of the guide 30.

A pair of bases 40 are attached to inner surfaces in intermediate positions of the booms 10. The bases 40 pivotally support proximal ends of open and dose type stands 41. In use, the stands 41 are placed in a ground engaging posture 42 extending rearward and downward from the proximal ends to the ground. When out of use, the stands 41 are contained between the fight and left booms 10, a contained posture (referenced 43) being shown in two-dot-and-dash lines in FIG. 13.

One of the stands 41a has an engaging member 44 exemplified by a pin projecting from a distal end region thereof. The stand 41*a* is maintained in the contained posture 43 with the engaging member 44 fixed to an engageable member 45 provided on the inner surface of one of the booms 10.

The other stand 41*b* is maintained in the contained posture 43 through engagement between similar engaging member 44 and engageable member 45 provided in a distal end region of the stand 41*b* and an intermediate position of the first-mentioned stand 41*a*.

The stands 41 have receivers 46 formed on upper surfaces in intermediate positions thereof, respectively. The cross rod (cross tube) 15 of the fight and left braces 14 has engaging forward projections 47 formed in positions opposed to the receivers 46.

Figure 10:
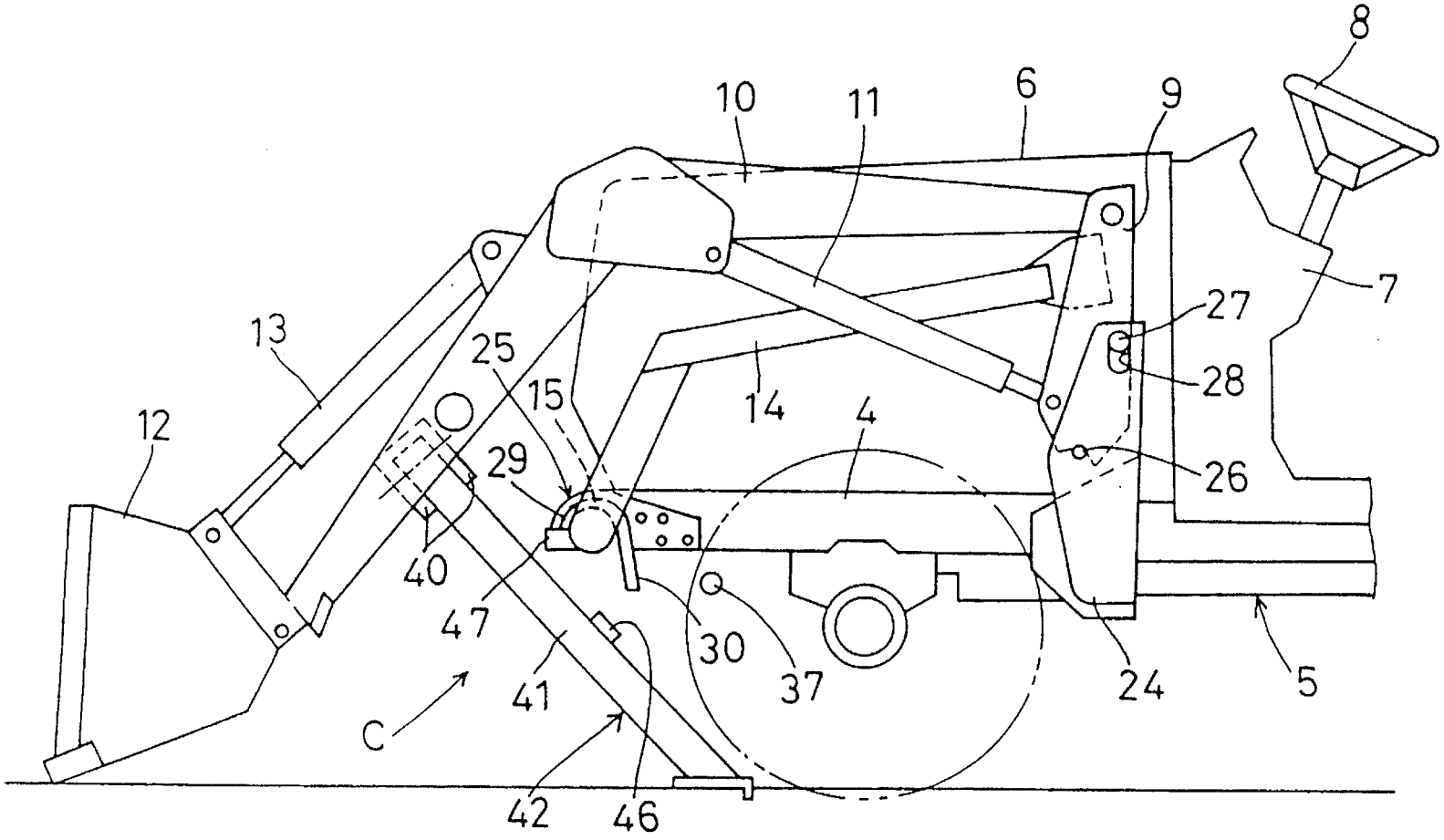
FIG. 10 is a side view of a working implement coupled to a working vehicle in a different embodiment.

This working implement 2 is attachable and detachable as follows. For detaching the working implement 2, as shown in FIG. 10, the rear portion of the working implement 2 is raised with the forward end of the bucket 12 contacting the ground, to disconnect the cross rod (cross tube) 15 of the fight and left braces 14 from the brace connectors 25. The connecting pins 27 are removed to disconnect the masts 9 from the mast mounts 24. The stands 41 are opened from the contained posture 43 to the ground engaging posture.

Figure 11:
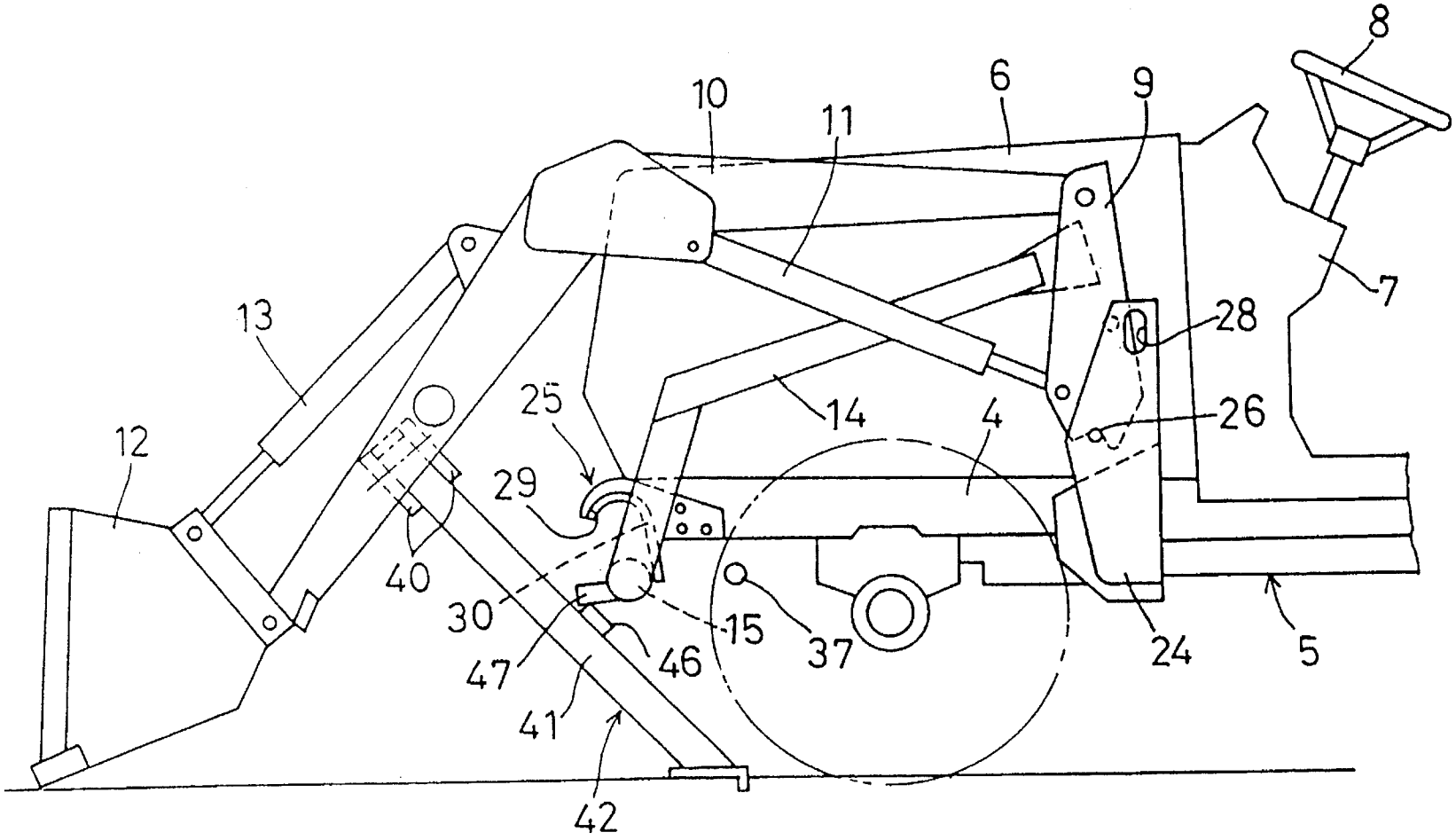
FIG. 11 is a side view of the working implement in process of coupling to or uncoupling from the working vehicle in the different embodiment.

Then, as shown in FIG. 11, the boom cylinders 11 are extended to cause the masts 9 to pivot about the pivot pins 26 to a forwardly inclined posture with the lower ends thereof contacting the mast mounts 24. At the same time, the forward ends of the braces 14 are lowered, whereby the engaging projections 47 of the cross rod (cross tube) 15 of the right and left braces 14 are received by the receivers 46 of the stands 41.

Figure 12:
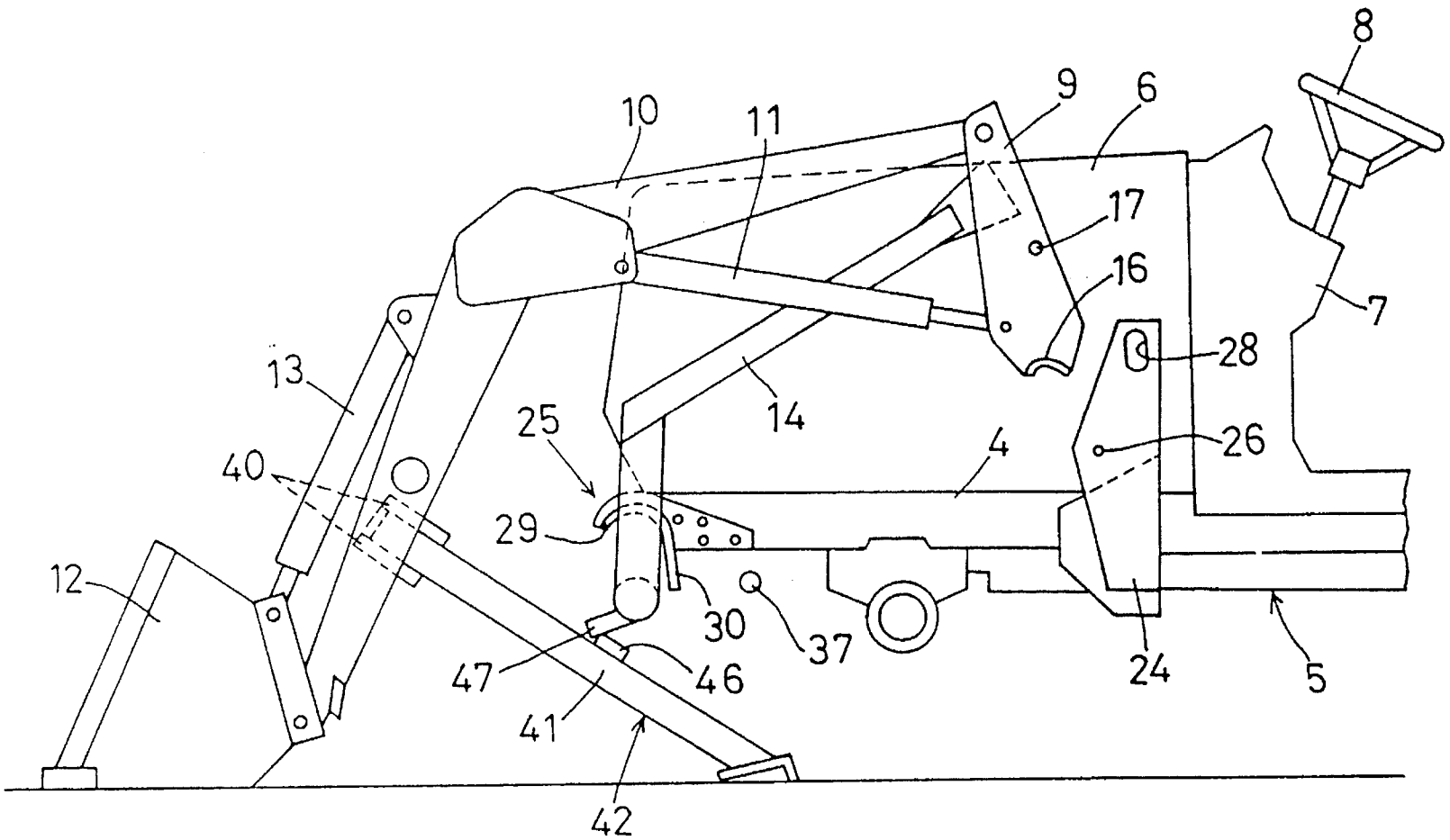
FIG. 12 is a side view of the working implement uncoupled from the working vehicle in the different embodiment.
Figure 13:
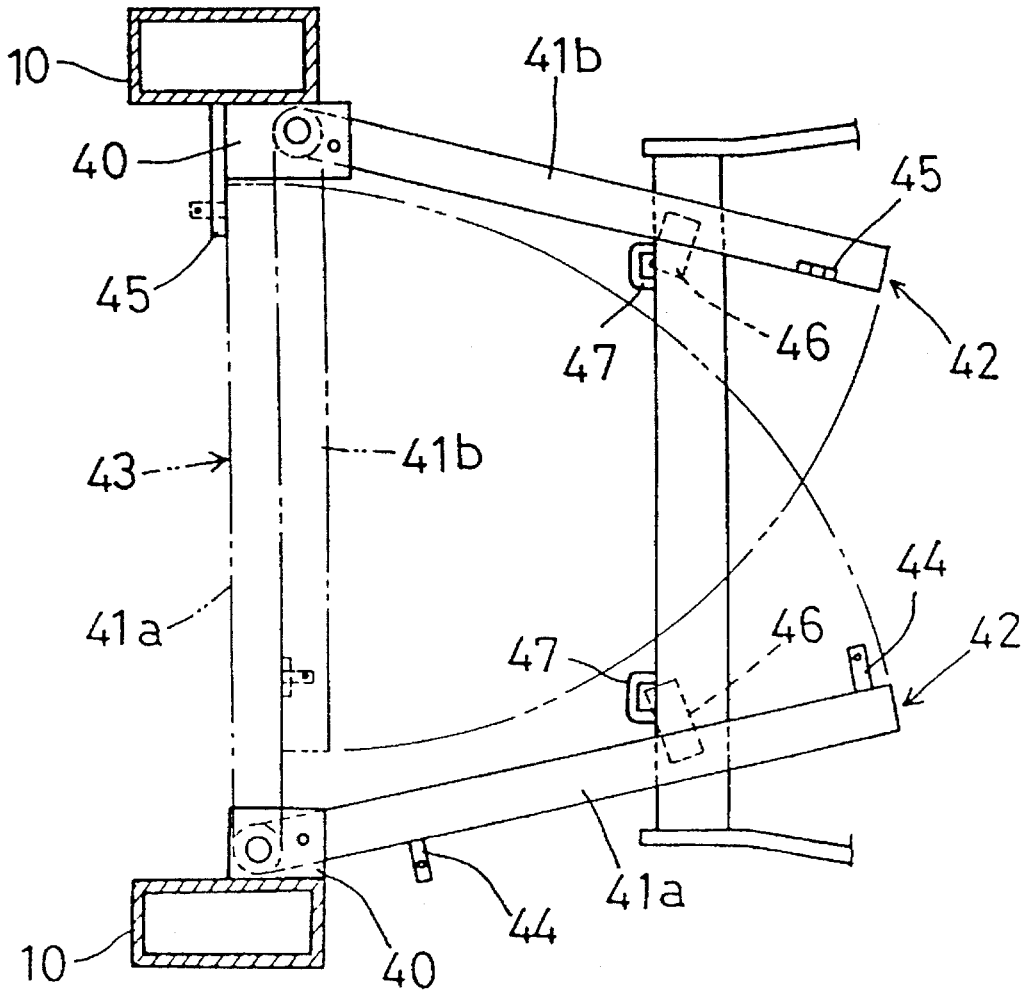
FIG. 13 is a view seen in a direction indicated by an arrow C in FIG. 10.

At this point, the operation of the boom cylinders 11 is stopped, and the tool cylinder 13 is contracted to place the bottom surface of the bucket 12 on the ground. Then, as shown in FIG. 12, the masts 9 are separated upward from the mast mounts 24. Thereafter the tractor body 5 may be moved backward. The working implement 2 is attachable to the tractor body 5 through a sequence reversed from the above.

This coupling apparatus for the working implement 2 has excellent stability since the working implement 2 is supported by the stands 41 connected to the booms 10. The working implement 2 may be maintained in this state for a long time without entailing oil drainage from the boom cylinders 11.

Figure 14:
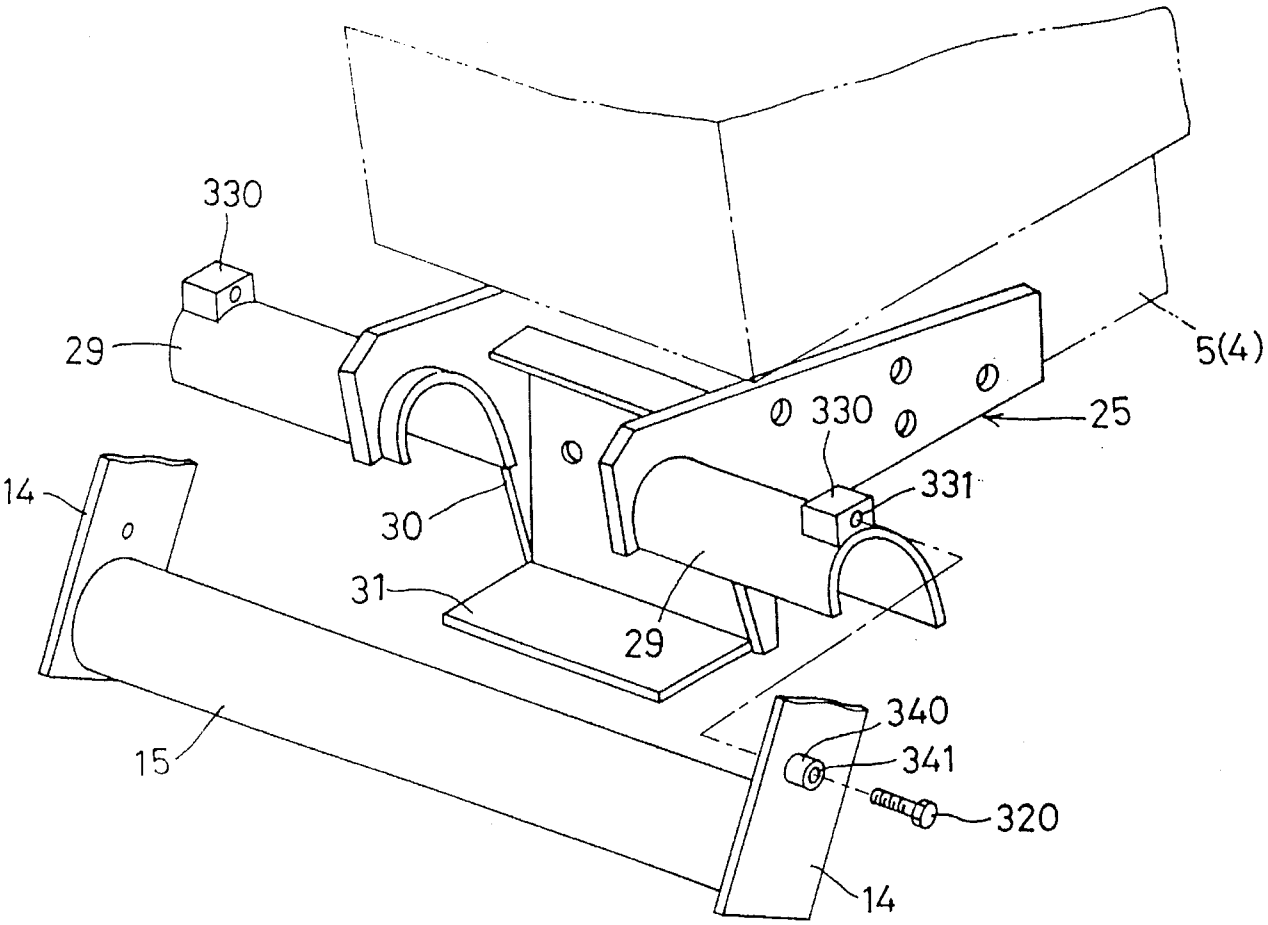
FIG. 14 is a perspective view of a brace connecting device in a further embodiment.

FIG. 5 shows one of the T-bolts 32 used to fix the cross rod 15 to the brace connectors 25 extending from the tractor body 5. This may be modified as shown in FIG. 14, in which coupling brackets 330 are formed at opposite ends of the coupling members 29 of the brace connectors 25. Each bracket 330 defines a threaded bore or pinhole 331. The fight and left braces 14 have bores 341 and bearing surfaces 340 for receiving connector pins 320 in positions opposed to the pinholes 331 when the cross rod 15 is fitted in the coupling members 29. These connector pins 320 may be replaced with T-bolts or the like.

What is claimed is:

1. In a front loader and a tractor having a coupling apparatus, the front loader having masts attachable to mast mounts of the tractor, and booms, boom cylinders and braces connected to the masts, the improvement wherein said apparatus comprises:

first coupling means including a first engaging member formed on each of said masts, and a first engageable member formed on each of said mast mounts for pivotable engagement with its respective said first engaging member;

second coupling means disposed above said first coupling means, and including a second connecting member formed on each of said masts, a second connectable member formed on each of said mast mounts, and a connecting pin for connecting each said second connecting member and its respective said second connectable member;

stand means for supporting said front loader when said masts are uncoupled form said mast mounts with said stand means attached to said front loader; and brace connecting means for connecting forward ends of said braces to a forward position of said tractor, said brace connecting means including a cross rod disposed at the forward ends of said braces, and receiver means provided in the forward position of said tractor for receiving said cross rod, said receiver means having fixing means for fitting on said cross rod from above when said masts are attached to said mast mounts, and support means for supporting said cross rod from below when said cross rod is uncoupled from said fixing means;

wherein said fixing means and said support means define a space therebetween which is larger than the diameter of said cross rod, said space enabling a pivotal movement of said cross rod around said first coupling means by an operation of said boom cylinders when said second connecting members and said second connectable members are not connected.

2. The invention as defined in claim 1, wherein said stand means includes stands and stand attaching members.

3. The invention as defined in claim 1, wherein said brace connecting means further includes lock members for locking said cross rod and said fixing means.

4. The invention as defined in claim 3, wherein each of said lock members includes an engaging element for engaging an engageable section formed in said cross rod.

5. The invention as defined in claim 1, wherein a working implement and said stand means are capable of contacting the ground when said front loader is detached from said tractor, whereby said front loader stands on the ground.

6. The invention as defined in claim 1, wherein said receiver means has a U-shaped section opening forwardly of said tractor.

7. The invention as defined in claim 1, wherein said support means is inclined forwardly of said tractor and said space enables detachment of said cross rod from said support means by forward movement of said cross rod relative to said receiving means in a direction substantially parallel to the ground from a position supported by said support means.

8. The invention as defined in claim 1 further including a guide extending between said fixing means and said support means wherein said cross rod is moved vertically downward along said guide during said pivotal movement.

9. In a front loader and a tractor having a coupling apparatus, the front loader having masts attachable to mast mounts of the tractor, and booms, boom cylinders and braces connected to the masts, said coupling apparatus comprising:

a first coupling including a first engaging member formed on each of the masts of the front loader, and a first engageable member formed on each of the mast mounts of the tractor for pivotable engagement with its respective said first engaging member;

a second coupling disposed above said first coupling, said second coupling including a connecting member formed on each of the masts of the front loader, a connectable member formed on each of the mast mounts of the tractor, and a connecting pin for connecting each said connecting member and its respective said connectable member;

stand means for supporting the front loader when the masts of the front loader are uncoupled from the mast mounts of the tractor, said stand releasably attached to the front loader; and a brace connector for connecting forward ends of the braces of the front loader to a forward position of the tractor, said brace connector including a cross rod disposed at the forward ends of the braces, and receiver means provided in the forward position of said tractor for receiving said cross rod, said receiver means having a fixing member adapted for fitting on said cross rod from above when the masts are attached to the mast mounts, a support adapted to support said cross rod from below when said cross rod is uncoupled from said fixing member, and a guide extending between said fixing member and said support;

wherein said fixing member and said support define a space therebetween which is larger than the diameter of said cross rod, said space enabling a pivotal movement of said cross rod around said first coupling by operation of the boom cylinders when said connecting members and said connectable members are not connected, wherein said cross rod is moved vertically downward along said guide during said pivotal movement, and wherein said space enables detachment of said cross rod from said support by forward movement of said cross rod relative to said receiver means in a direction substantially parallel to the ground.

10. The invention as defined in claim 9 further including a stand storage support attached to one of the braces of the front loader for storing said stand when said stand is not in use.

11. The invention as defined in claim 9, wherein said stand includes a pair of stand members which are releasably attached to the masts of the front loader.

12. A front loader coupling apparatus as claimed in claim 11 further including stand attaching members attached to each of the masts for releasably attaching one of said stand members to each of the masts.

13. The invention as defined in claim 11, wherein each said stand attaching member includes a pair of holder plates coupled to opposite sidewalls of the masts wherein said holder plates are adapted to receive one of said stand members therein.

* * * * *

UNITED STATES PATENT AND TRADEMARK OFFICE

CERTIFICATE OF CORRECTION

PATENT NO. : 5,536,134

DATED : July 16, 1996

INVENTOR(S) : Masami Hirooka

It is certified that error appears in the above-indentified patent and that said Letters Patent is hereby corrected as shown below:

Claim 10 Line 17 Column 10 "said stand" should read --said stand means-- (both occurrences).

Claim 11 Line 19 Column 10 "said stand" should read --said stand means--.

Claim 13 Line 27 Column 10 "11," should read --12,--.

Signed and Sealed this

Twenty-sixth Day of November 1996

*Attest:*

Bruce Lehman

BRUCE LEHMAN

*Attesting Officer*

*Commissioner of Patents and Trademarks*